United States Patent [19]

Rotar et al.

[11] 4,251,928

[45] Feb. 24, 1981

[54] METAL IMPREGNATED DRYER FABRIC

[75] Inventors: Frederick D. Rotar, West Chester; Clement B. Edgar, Jr., Devon, both of Pa.

[73] Assignee: Asten Group Inc., Devon, Pa.

[21] Appl. No.: 9,760

[22] Filed: Feb. 5, 1979

Related U.S. Application Data

[62] Division of Ser. No. 911,044, May 30, 1979, abandoned.

[51] Int. Cl.[3] ..... B43L 7/06

[52] U.S. Cl. ..... 34/116; 34/123; 139/383 A; 162/360 R; 162/DIG. 1; 427/428

[58] Field of Search ..... 428/328, 256, 263, 285; 427/428, 343, 391, 361, 362, 363, 364, 365, 395; 139/383 A; 162/DIG. 1, 358, 359, 360 R; 34/116, 123

[56] References Cited

U.S. PATENT DOCUMENTS

| | | | |
|---|---|---|---|
| 1,944,600 | 1/1934 | Greene | 34/123 |
| 2,437,254 | 3/1948 | Hill | 34/116 |
| 2,526,318 | 10/1950 | Battin | 34/116 X |
| 2,630,620 | 3/1953 | Rand | 428/91 X |
| 2,748,019 | 5/1956 | Schramm | 117/31 |
| 2,896,336 | 7/1959 | Shoumatoff | 34/116 X |
| 3,067,779 | 12/1962 | Draper | 139/383 A |
| 3,075,274 | 1/1963 | Mizell | 139/383 A X |
| 3,250,662 | 5/1966 | Seaman | 161/91 |
| 3,503,139 | 3/1970 | Mahoney | 34/111 |
| 3,591,400 | 7/1971 | Palmquist et al. | 117/3.3 |
| 3,640,832 | 2/1972 | Kurz | 161/160 |
| 3,753,298 | 8/1973 | Ely | 34/116 |
| 3,925,906 | 12/1975 | Chance et al. | 34/123 X |

FOREIGN PATENT DOCUMENTS 1603267 5/1971 France .

*Primary Examiner*—Shrive P. Beck

*Attorney, Agent, or Firm*—Watson, Cole, Grindle & Watson

[57] ABSTRACT

A dryer fabric impregnated with metallic particles so as to increase the thermal conductivity of the fabric and also reduce its emissivity. The dryer fabric is a woven fabric having a plurality of interstices between its warp and weft yarns. By coating the fabric with a synthetic resin mixture containing metallic particles, such as aluminum particles, the interstices are substantially filled with metallic particles thereby improving the thermal properties of the fabric.

10 Claims, 7 Drawing Figures

METAL IMPREGNATED DRYER FABRIC

This is a divisional, of application Ser. No. 911,044 filed May 30, 1979 and now abandoned.

BACKGROUND OF THE INVENTION

The present invention relates to dryer fabrics for use in conventional, single fabric, and dual fabric configurations such as those illustrated in FIGS. 1A, 1B, and 1C, respectively.

The dryer section of a papermaking machine contains a plurality of dryer cylinders which emit heat for drying the wet paper web that has been formed. During the normal operation of the dryer section, such as shown in FIG. 1A, the wet paper web 3 is pressed by dryer fabrics 2*a* and 2*b* against the dryer cylinders 1*a* through 1*g*. As the dryer fabrics transverse the dryer cylinders and the paper web, the fabrics remove heat from the cylinders and paper web. This heat is lost by radiation from the surface of the bottom fabric as the fabric passes under the cylinders so as to return to the starting point of the dryer section. The heat is further lost by radiation from the surface of the top fabric as it passes over the cylinders and returns to the starting point. The heat emitted by the dryer fabric during its return, therefore, is lost in the process. Rollers 1*h* and 1*i* are further support rollers in the embodiment shown in FIG. 1A as well as the embodiments shown in FIGS. 1B and 1C, which are discussed below.

The single fabric configuration, such as shown in FIG. 1B, has been developed in recent years for the dryer section of a papermaking machine; this type of configuration is disclosed in U.S. Pat. No. 3,503,139 to Mahoney. In the configuration of FIG. 1B, a wet paper web 3 is completely supported on the surface of a dryer fabric 2 which traverses dryer cylinders 1*a* through 1*g*. Such a configuration helps to eliminate any fluttering of the wet paper web, especially when the machine is driven at high speed. The benefits of employing a single fabric configuration, however, are somewhat offset by the reduction in heat transfer between one row of dryer cylinders and the paper web where the fabric lies between the web and the cylinders. This loss in heat transfer reduces the overall drying rate of the section and can result in production losses.

Alternatively, the reduction in heat transfer is compensated for by increasing the temperature of the drying cylinders. This, however, results in unusually high energy requirements for the papermaking machine, which is obviously undesirable. In addition, in some machines there is significant restraint on the temperature level at which the cylinders can be used.

In a dual, or sandwich, fabric configuration, as shown in FIG. 1C, the paper web 3 travels along a path between dryer fabrics 2*a* and 2*b* across dryer cylinders 1*a* through 1*g*. The primary advantage to utilizing such a configuration is that the paper web is completely transported thereby significantly decreasing the possibility of web breakage. In such systems, however, the dryer fabrics insulate the paper web from both the top and bottom drying cylinders.

Throughout this application the terms thermal conductivity and emissivity are used. These terms are defined as follows. The term thermal conductivity refers to heat flow per unit of cross sectional area (BTU/HR-FT$^2$) through the thickness of the fabric subjected to a temperature differential of one degree Fahrenheit from face to back multiplied by the fabric thickness (BTU-IN/HR-FT$^{-2}$-°F.). The term emissivity refers to the ratio of the radiant energy emitted by the surface of the fabric at a given temperature to that emitted by the ideal radiator (i.e., a "black body") at the same temperature.

Dryer fabrics are typically chemically treated with either an acrylic or resorcinol formaldehyde resin. The thermal conductivity properties of such resins are very similar to the monofilament and multifilament fibers and other yarns that are used for weaving the dryer fabrics. The poor thermal conductivity properties of the fibers and yarns coupled together with the openness of the woven structure create fairly poor heat conducting characteristics for the dryer fabrics.

In addition to the insulating properties of the resin treatments and the fibers and yarns themselves, other chemicals that are typically added to the resin treatment also have fairly good insulating properties. Often, various fillers and extenders are added to the resin used for treating the fabric in order to improve properties such as the coefficient of friction, abrasiveness and color-/opacity. Examples of such chemicals are titanium dioxide, calcium carbonate, diatomaceous earth, Georgia clay, colored pigments, graphite, carbon black, silica and various ceramics.

Various techniques for coating fabrics with resins have been extensively developed in the prior art. Examples of such coating processes are disclosed in the following U.S. patents: 3,250,662 to N. R. Seaman; 3,519,475 to C. Hoyle et al; and 3,653,961 to L. R. Lefkowitz.

Another patent that may be of interest is U.S. Pat. No. 3,067,779 to J. H. Draper, Jr. This patent discloses utilizing metal strands that are woven into the fabric. Such metal strands serve as electrical conductors through which electricity can pass. Such conductors serve as heating elements for drying the paper being produced.

SUMMARY OF THE INVENTION

An object of the present invention is to provide an improved papermaking fabric having a higher level of thermal conductivity than prior fabrics.

Another object of the present invention is to provide an improved dryer fabric having a higher level of thermal conductivity than prior dryer fabrics.

A further object of the present invention is to provide an improved dryer fabric in which the emissivity property is significantly reduced.

Still another object of the present invention is to provide a dryer fabric in which the amount of heat lost during its utilization is significantly decreased thereby requiring less energy to be utilized in the drying section of a papermaking machine.

In order to achieve these objectives, the present invention provides a woven dryer fabric having its interstices impregnated with a resin containing metallic particles. The use of the resin containing the metallic particles for treating the dryer fabric significantly increases the thermal conductivity property of the fabric. By utilizing the present invention, it has been possible to achieve a 60% increase in the thermal conductivity. The resin containing metallic particles also significantly reduces the emissivity of the fabric surface. As a result, the heat losses, such as discussed above, are minimized. Consequently less energy is required for drying the paper web.

In producing the metal impregnated dryer fabric according to the present invention, it has been found desirable to use a Hydropaste produced by Alcoa that contains aluminum particles. In the preferred embodiment of the present invention, the particular material is Alcoa Hydropaste N 830. The Hydropaste is mixed with the resin mixture that is to be applied to the dryer fabric. Examples of such resin mixtures and the backcoating process for treating the fabrics with a thickened resin mixture are disclosed in U.S. patent application Ser. No. 891,046 of Frederick D. Rotar, filed Mar. 28, 1978, and commonly owned herewith.

The Alcoa Hydropaste contains aluminum pigments and is water dispersable; thus, it can be readily dispersed with or without the addition of surfactants in water and in many latexes and synthetic resin emulsions. The Hydropaste also contains a built in protection for retarding pressure development from the formation of hydrogen gas when the aluminum mixes with water thereby making the use of the Hydropaste safe.

In order to produce the metal impregnated dryer fabric of the present invention, the fabric must be coated on at lease one side using a backcoating treatment process, such as disclosed in the above noted patent application Frederick D. Rotar. If only one surface of the fabric is treated, a two-sided fabric is effectively produced. The two-sided fabric is a fabric in which its two surfaces exhibit different surface properties.

The backcoating treatment is especially beneficial when using all synthetic monofilament fabrics that have a high permeability open mesh. By utilizing the backcoating process, the fabric need only be treated once since the resin mixture containing the metallic particles is highly viscous. In addition, by utilizing a backcoating treatment, it is much easier to apply the aluminum since the aluminum will not settle to the bottom of the tank in the thickened resin mixture.

It is also possible to treat the dryer fabric so that it has a one-sided effect, i.e. the surface characteristics of the front and back surfaces of the fabric are very similar, or even identical. Such a treatment is often used when treating soft-faced fabrics. In carrying out the treatment, a low viscosity, low solids content resin mixture containing metallic particles is first applied by a roller applicator to one surface of the fabric. The roller applicator is driven at a sufficiently high speed so that the desired amount of resin mixture is delivered to the fabric for causing total impregnation or saturation of the fabric. The treated surface of the fabric is then wiped clean with a doctor blade. Even though this treatment produces a small permeability drop, a second backcoating with a high viscosity and high solids content resin mixture containing the metallic particles is applied and further reduces the permeability. In the second treatment, a thickened resin mixture containing metallic particles is applied by the backcoating process to the other surface of the fabric.

PREFERRED EMDODIMENTS OF THE PRESENT INVENTION

Figure 3:
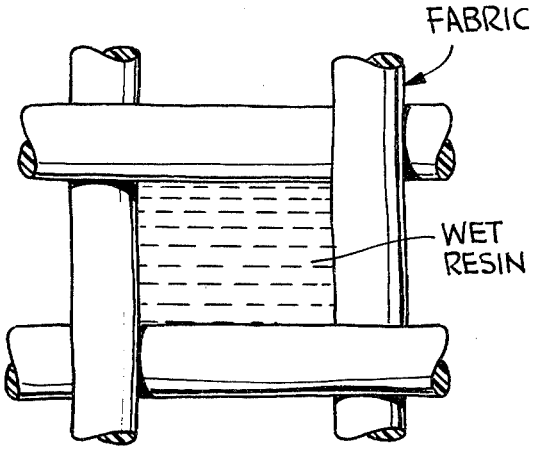
FIG. 3 is an enlarged view of one of the interstices after the wet resin mixture containing the metallic particles has been applied.
Figure 4:
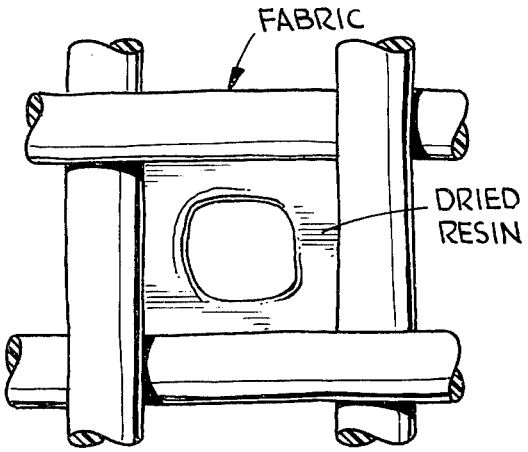
FIG. 4 is a view similar to FIG. 3 after the resin mixture has dried.
Figure 5:
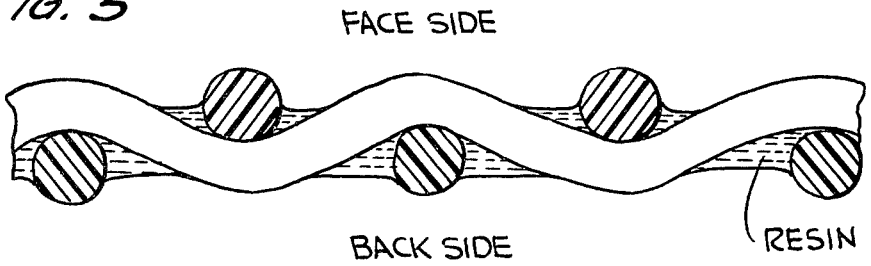
FIG. 5 is an illustrative cross-sectional view of a woven fabric that has been impregnated with a resin mixture containing the metallic particles.

In order to improve the thermal conductivity properties of a dryer fabric and also to reduce the emissivity of the fabric, in accordance with the present invention, it has been found that the fabric can be coated with a sufficient quantity of a resin mixture containing metallic particles. The quantity of the resin mixture that is applied to the dryer fabric is sufficient to substantially impregnate the interstices of the fabric, such as shown in FIGS. 3 and 4. An illustrative cross-sectional view of a fabric having its interstices impregnated with the resin mixture containing the metallic particles is shown in FIG. 5. The particular nature of the chemical treatment, including its viscosity and solids content, largely depends on the type of fabric that is to be treated as well as the desired end use for the fabric.

In treating the dryer fabric, either a one-sided or a two-sided fabric can be formed. In a one-sided fabric, both sides of the fabric are very similar, and in fact often substantially identical, in construction, appearance and surface characteristics. In a two-sided fabric, one side of the fabric is different from the other side and thus the fabric in essence has a front surface and a back surface.

Figure 1A:
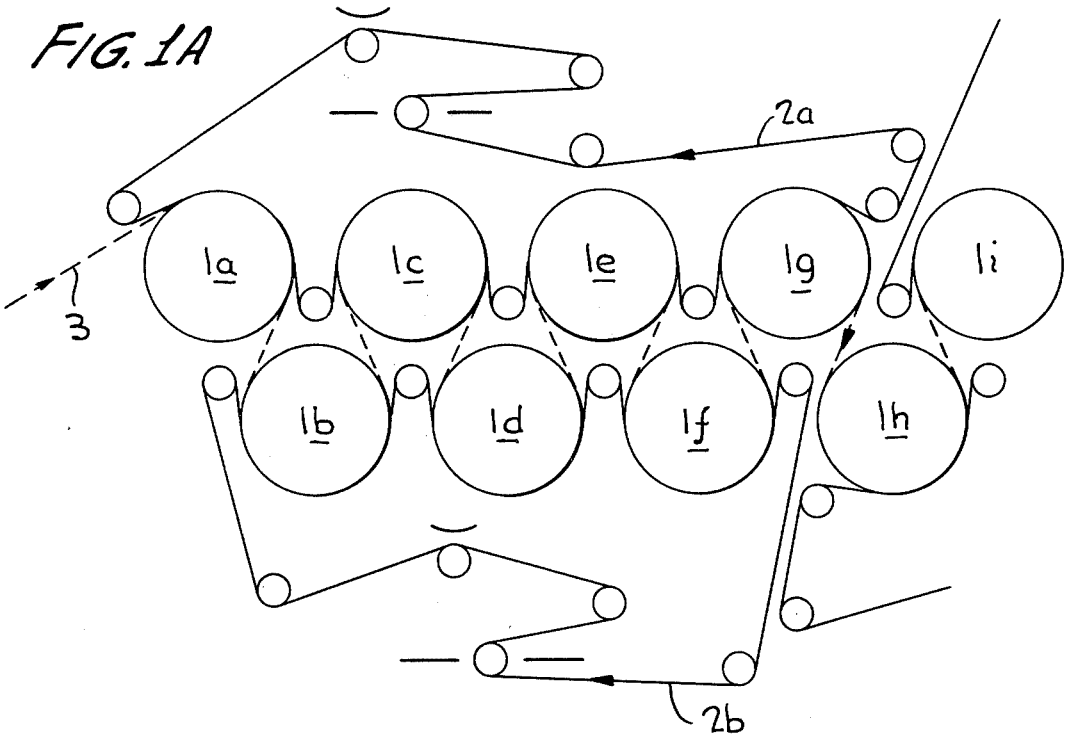
FIGS. 1A, 1B, and 1C illustrate three different embodiments of dryer sections of a papermaking machine.
Figure 1B:
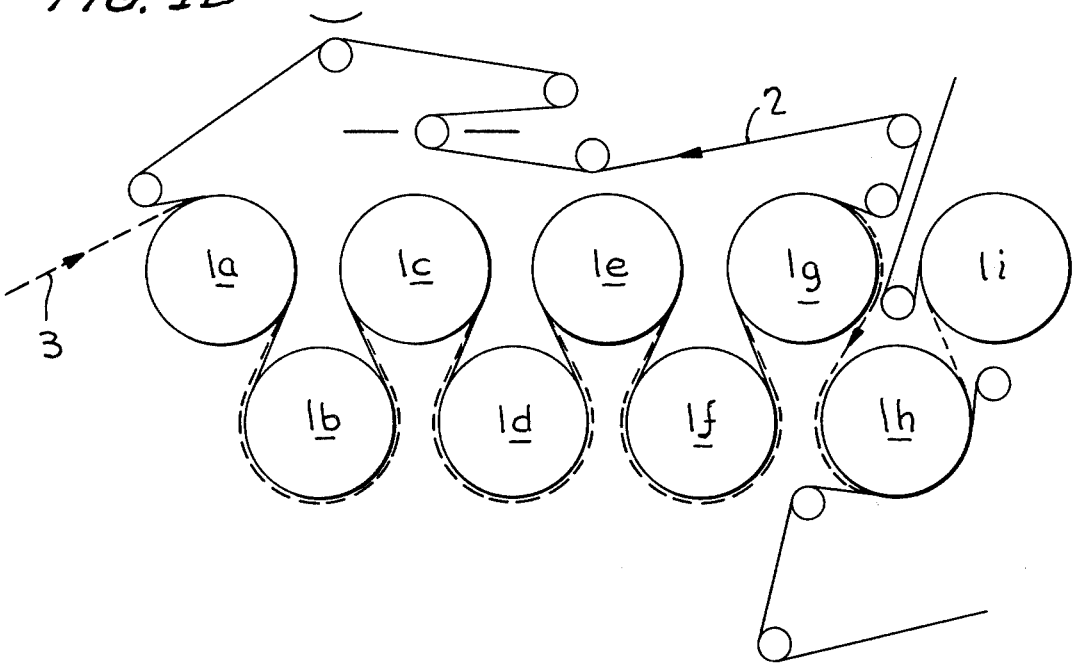
Figure 1C:
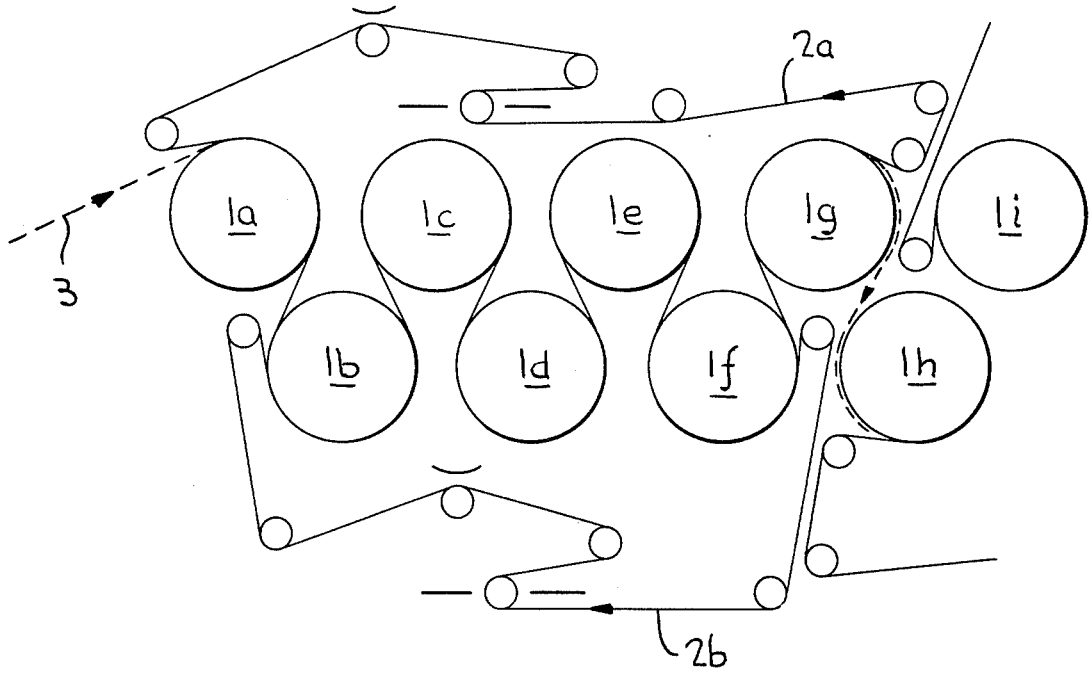
Figure 2:
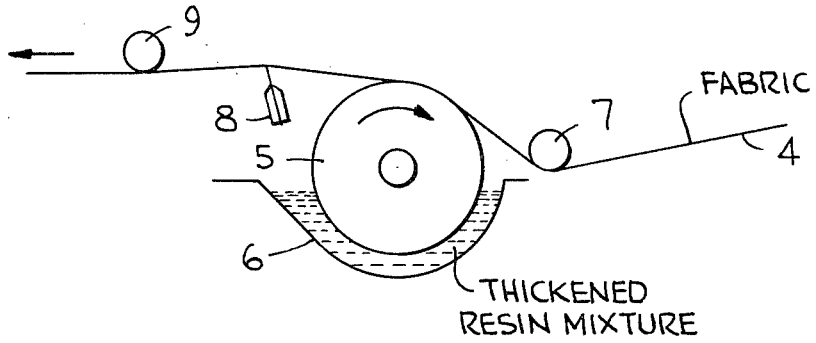
FIG. 2 is a system for backcoating a dryer fabric.

In order to provide the dryer fabric with the desired thermal conductivity, the fabric must be coated on at least one side with the metallic containing resin using a backcoating process. An exemplary embodiment of the apparatus for carrying out a backcoating process is shown in FIG. 2. With such a coating process, dryer fabric 4 that is to be coated moves in a direction across roller applicator 5. The roller applicator is generally driven in a direction opposite to the movement of the fabric. As roller applicator 5 rotates, it picks up the thickened resin mixture that contains the metallic particles from trough 6. The resin mixture is then applied to the back surface of the dryer fabric. Rollers 7 and 9 serve to maintain the fabric in contact with roller applicator 5. After the resin mixture has been applied, excess resin is wiped off of the fabric by doctor blade 8.

When a one-sided fabric is desired, the fabric is treated on both sides. In this situation the fabric is first coated on one side with a low viscosity, low solids content resin mixture that contains aluminum particles. The roller applicator is driven at a sufficiently high speed so that the desired amount of resin mixture is delivered for causing total impregnation or saturation of a fabric. The excess material is then wiped off of the fabric by a doctor blade. Next, the other side of the fabric is coated with a thickened resin mixture which also contains aluminum particles. Due to the relatively large particle size and high density of the aluminum particles, the resin mixture must either be relatively thick or vigorously agitated and recirculated so as to prevent the aluminum particles from settling to the bottom of the trough. Both coatings are applied in sufficient quantities so as to impregnate the fabric.

In the first coating operation, i.e. the coating with the lower viscosity mixture for saturation purposes, the viscosity of the mixture is approximately 1,000 CPS±100 CPS; the solids content of the mixture is 7.25%±0.4%; and the aluminum content is 3.60%. In the final mixture for this first operation, the mixture contains: water 83.2%; an anti-foaming agent 0.2%; a surfactant 1%; Alcoa Hydropaste N-830 (aluminum) 5%; Rhoplex TR 407 (acrylic latex) 5%; ammonium hydroxide (buffer) 0.6%; and Acrysol ASE-60 (thickener) in a 50% mixture with water, 5%. In the thickened resin mixture, the viscosity is approximately 5,000 CPS±500 CPS, the total solids content is approximately 20%±1.0% and the aluminum solids content is approximately 10%±0.5%. The total contents of the resin mixture is as follows: water 61.9%; an antifoaming agent 0.2%; ammonium sulfamate (catalyst) 0.4%; a surfactant 1%; Alcoa Hydropaste N-830 (aluminum) 10%; Rhoplex TR 407 (acrylic latex) 10%; ammonium hydroxide (buffer) 0.6%; and Acrysol ASE-60 (a thickener) in a 50% mixture with water, 16%.

The above coating operation is generally used where the dryer fabric has soft yarn on one face but monofilament fibers exposed on its other face. With such a fabric, it is also possible to apply both coatings to the back surface of the fabric, but in sufficient quantities so that it extends through to the front surface. If a complete monofilament fabric is to be treated for providing a one-sided fabric, then both sides of the fabric can be treated with the thickened resin mixture containing the aluminum particles.

The viscosity and the solids content of the resin mixture depends on the initial air permeability of the fabric to be coated as well as the desired reduction in air permeability. A monofilament fabric having a high initial air permeability, i.e. a relatively open mesh, that requires a significant reduction in its air permeability will be treated with a mixture having higher solids content and higher viscosity than a mixture used for treating a fabric initially having a lower air permeability.

For treating fabrics made completely from monofilament fibers, the viscosity range of the mixture will be between 3,000 and 6,000 CPS and the total solids content will be between 10 and 30%. Since the thermal conductivity property of the finished fabric depends upon its aluminum content, the quantity of aluminum added to the mixture should be based upon the fabric weight and characteristics rather than on the total bath weight. The quantity of the aluminum should be equal to or less than the quantity of resin solids in the mixture in order to obtain an acceptable crock resistance. The crock resistance is the resistance of the fabric to loss of aluminum particles by rubbing or chipping.

When treating fabrics which are made with multifilament fibers or spun yarns, the characteristics of the resin mixture will change. In treating such fabrics, the resin mixture will have a lower viscosity but not necessarily a lower solids content. The total solids content of the mixture still depends on the intended air permeability reduction to be achieved by the backcoating treatment.

In general, the quantity of resin mixture impregnated in the woven fabric is between 10 and 20% of the weight of the treated fabric. The resin mixture in turn contains between 5 and 25% by weight of aluminum particles.

It is noted that the above description and the accompanying drawings are provided merely to present exemplary embodiments of the present invention and that additional modifications of such embodiments are possible within the scope of this invention without deviating from the spirit thereof.

We claim:

1. In a papermaking machine having a dryer section including a plurality of dryer cylinders which emit heat for drying a wet paper web, a papermaking dryer fabric having a face side and a back side, means passing said dryer fabric about said cylinders for a portion of the circumference thereof while said back side is in direct contact with a first set of said cylinders, and means passing the web about and in intimate contact with said face side of said fabric as said fabric and the web pass partially about said first set of cylinders, said fabric passing from a last of said cylinders to a first of said cylinders along a return path wherein said fabric is out of contact with any of said cylinders, the improvement wherein said dryer fabric comprises an elongated web formed of a plurality of synthetic strands and having a plurality of interstices forming an open mesh of a first air permeability value, said fabric having a first coating applied to one of said sides thereof so as to substantially impregnate said fabric, said coating comprising a resin having a quantity of metallic particles therein, said resin containing said particles lying wholly within said fabric and after said resin is dried substantially filling said interstices without covering said sides of said fabric for thereby forming an open mesh having a second air permeability value and for increasing the thermal conductivity of said fabric, whereby heat is conducted from said cylinders to the web by said fabric having said back side thereof in direct contact with said first set of cylinders, and whereby said coated fabric has a reduced heat emissivity property thereby reducing heat losses of said fabric when passing along said return path.

2. In the machine according to claim 1, wherein said fabric has a second coating on an opposite side thereof, said second coating comprising a resin having a quantity of metallic particles therein, said second coating lying wholly within said fabric and after said resin thereof is dried substantially filling said interstices without covering said sides of said fabric for thereby forming said open mesh having an air permeability value less than said second air permeability value and for further increasing the thermal conductivity of said web.

3. In the machine according to claim 1, wherein said first coating before being first applied to said fabric has a viscosity of approximately 5,000 CPS±500 CPS, a total solids content of approximately 20%±1% and a metal particles content of approximately 10%±0.5%.

4. In the machine according to claim 2, wherein said second coating before being first applied to said fabric has a viscosity of approximately 1,000 CPS±100 CPS, a total solids content of 7.25%±0.4% and a metal particles content of 3.6%.

5. In the machine according to claim 1, wherein said resin is an acrylic resin and said metallic particles are aluminum.

6. In the machine according to claim 2, wherein said resin is an acrylic resin and said metallic particles are aluminum.

7. In the machine according to claim 1, wherein the quantity of said resin impregnated in said interstices is between 10 and 20% of the weight of said fabric, and the quantity of said metallic particles is between 5 and 25% of the weight of resin.

8. In the machine according to claim 1, wherein said fabric is made from monofiliment fibers, and said coating before first being applied to said fabric has a viscosity of between 3,000 and 6,000 CPS with a total solids content of between 10 and 30%.

9. In the machine according to claim 1, wherein another dryer fabric is provided having a face side and a back side, means passing said another fabric about said cylinders for a portion of the circumference thereof while said face side of said another fabric is in intimate contact with the web, the web thereby being sandwiched between said fabrics, said another fabric passing from an end one of said cylinders to a beginning one of said cylinders along a return path wherein said another fabric is out of contact with any of said cylinders, said another fabric comprising an elongated web formed of a plurality of synthetic strands and having a plurality of interstices forming an open mesh of said first air permeability value, said another fabric having a coating applied to one of said sides thereof so as to substantially impregnate said another fabric, said another fabric coating comprising a resin having a quantity of metallic particles therein which resin lies wholly within said another fabric and after being dried substantially fills said another fabric interstices without covering said sides of said fabric for thereby forming an open mesh having said second air permeability value and for increasing the thermal conductivity of said another fabric, whereby said coated another fabric has a reduced heat emissivity property thereby reducing heat losses thereof when passing along said return path.

10. In a papermaking machine having a dryer section including a plurality of dryer cylinders which emit heat for drying a wet paper web, a papermaking dryer fabric having a face side and a back side, means passing said dryer fabric about said cylinders for a portion of the circumference thereof while said web is disposed between said cylinders and said fabric, said fabric passing from a last of said cylinders to a first of said cylinders along a return path wherein said fabric is out of contact with any of said cylinders, the improvement wherein said dryer fabric comprises an elongated web formed of a plurality of synthetic strands and having a plurality of interstices forming an open mesh of a first air permeability value, said fabric having a first coating applied to one of said sides thereof so as to substantially impregnate said fabric, said coating comprising a resin having a quantity of metallic particles therein, said resin containing said particles lying wholly within said fabric and after said resin is dried substantially filling said interstices without covering said sides of said fabric for thereby forming an open mesh having a second air permeability value for altering the heat emissivity property of said fabric, whereby said coated fabric has a reduced heat emissivity property thereby reducing heat losses of said fabric when passing along said return path and increasing the temperature of said fabric.

* * * * *